US009024228B2

(12) United States Patent
Yamaguchi et al.

(10) Patent No.: US 9,024,228 B2
(45) Date of Patent: May 5, 2015

(54) PLASMA CUTTING DEVICE, PLASMA TORCH, AND COOLING DEVICE FOR PLASMA TORCH

(75) Inventors: Yoshihiro Yamaguchi, Nomi (JP); Shigeo Morimoto, Hiratsuka (JP); Mikio Minonishi, Hiratsuka (JP)

(73) Assignees: Komatsu Ltd., Tokyo (JP); Komatsu Industries Corporation, Komatsu-shi (JP)

( * ) Notice: Subject to any disclaimer, the term of this patent is extended or adjusted under 35 U.S.C. 154(b) by 611 days.

(21) Appl. No.: 11/907,299

(22) Filed: Oct. 11, 2007

(65) Prior Publication Data

US 2008/0093346 A1 Apr. 24, 2008

(30) Foreign Application Priority Data

Oct. 18, 2006 (JP) ..... 2006-283767
Jul. 19, 2007 (JP) ..... 2007-188513

(51) Int. Cl.
*B23K 9/00* (2006.01)
*H05H 1/34* (2006.01)
*H05H 1/28* (2006.01)

(52) U.S. Cl.
CPC . *H05H 1/34* (2013.01); *H05H 1/28* (2013.01); *H05H 2001/3442* (2013.01); *H05H 2001/3484* (2013.01); *H05H 2001/3457* (2013.01)

(58) Field of Classification Search
USPC ..... 219/75, 121.39, 121.48–121.52, 121.59
See application file for complete search history.

(56) References Cited

U.S. PATENT DOCUMENTS

| | | | | |
|---|---|---|---|---|
| 3,130,292 | A | 4/1964 | Gage et al. | |
| 4,125,754 | A * | 11/1978 | Wasserman et al. | 219/121.47 |
| 4,549,065 | A * | 10/1985 | Camacho et al. | 219/121.48 |
| 4,628,177 | A * | 12/1986 | Dempsey et al. | 219/121.49 |
| 5,247,152 | A * | 9/1993 | Blankenship | 219/121.49 |
| 5,451,740 | A * | 9/1995 | Hanus et al. | 219/121.59 |
| 6,054,669 | A * | 4/2000 | Warren, Jr. | 219/121.39 |
| 2001/0007320 | A1 * | 7/2001 | Severance et al. | 219/121.48 |

(Continued)

FOREIGN PATENT DOCUMENTS

| | | |
|---|---|---|
| GB | 1 268 843 | 4/1969 |
| GB | 1 520 000 | 10/1975 |
| JP | A-H06-071450 | 3/1994 |

(Continued)

OTHER PUBLICATIONS

Office Action mailed Dec. 13, 2011 in corresponding JP Application No. 2007-188513 (and English Translation).

(Continued)

*Primary Examiner* — Brian Jennison
(74) *Attorney, Agent, or Firm* — Posz Law Group, PLC

(57) ABSTRACT

In order to increase the flow rate of coolant liquid supplied to the nozzle (88) of a plasma torch (10) and to extend the life of the plasma torch (10), within the plasma torch (10), an electrode coolant liquid passage (60, 84, 85, 86, and 64) which supplies coolant liquid to an electrode (80), and a nozzle coolant liquid passage (56, 70, 92, 72 and 68) which supplies coolant liquid to the nozzle (88), are provided separately as independent coolant liquid passages which extend in parallel, and which are mutually electrically insulated from one another. Moreover, the flow rate of coolant liquid in the nozzle coolant liquid passage is greater than the flow rate of coolant liquid in the electrode coolant liquid passage.

16 Claims, 6 Drawing Sheets

(56) References Cited

U.S. PATENT DOCUMENTS

| | | | | |
|---|---|---|---|---|
| 2005/0092718 | A1 | 5/2005 | Brandt et al. | |
| 2007/0178020 | A1 * | 8/2007 | Atlas et al. | 422/105 |

FOREIGN PATENT DOCUMENTS

| | | |
|---|---|---|
| JP | A-H06-076985 | 3/1994 |
| JP | B-2640707 | 5/1994 |
| JP | A-H11-285835 | 10/1999 |
| JP | A-2005-118816 | 5/2005 |
| WO | WO 2007/025505 A2 | 3/2007 |

OTHER PUBLICATIONS

Office Action issued Jun. 14, 2010 for corresponding German patent application No. 10 2007 046 695.3-55 (English translation enclosed).

Office Action mailed Jul. 31, 2012 in corresponding JP Application No. 2007-188513.

* cited by examiner

PLASMA CUTTING DEVICE, PLASMA TORCH, AND COOLING DEVICE FOR PLASMA TORCH

TECHNICAL FIELD

The present invention relates to a plasma cutting device, to a plasma torch, and to a cooling device for a plasma torch, and in particular relates to improvement in technique for cooling a plasma torch.

BACKGROUND ART

The electrode and nozzle of a plasma torch are directly exposed to a high temperature plasma arc. In order to prevent attrition of the electrode and the nozzle due to this high temperature, normally, cooling water is flowed through the interior of the electrode and around the exterior of the nozzle, so that the electrode and the nozzle are cooled (refer to Patent Document #1). Generally, this cooling water is fed under pressure to the torch by a pump from a water tank of a cooler unit which is installed exterior to the plasma cutting device. Within the torch, this cooling water first passes through the base end portion of the torch and enters into a water passage internal to the electrode and cools the electrode, and thereafter enters into a water passage which surrounds the outer surface of the nozzle and cools the nozzle. Thereafter, the cooling water passes through the base end portion of the torch and is expelled to the exterior of the torch, enters into a heat exchanger (which may be a radiator or chiller type heat exchanger) of the above mentioned cooler unit which dissipates the heat in the water, and then returns to the above described water tank for a second time. In this manner, the cooling water circulates around a single loop water cooling circuit, in which it passes in order from the cooler unit past the electrode and the nozzle within the torch, and then returns to the cooler unit.

In order to enhance the life of the electrode, it is considered to be effective to flow the water at high speed and at high volume in the neighborhood of a heat resistant insert (made from a high melting point metal such as hafnium or zirconium) in the tip end portion of the electrode, as close to this heat resistant insert as possible. Generally, a cooling water supply pipe which projects out from the torch base end portion is inserted deeply into a water passage internal to the electrode (a blind hole which extends from the base end surface of the electrode to a depth in the electrode tip end portion which is immediately behind the rear end of the heat resistant insert), so far thereinto as to reach near its bottom. By narrowing down the gap between the bottom surface of this water passage and the tip end surface of the pipe, the flow speed of the cooling water which passes over this bottom surface of the water passage is increased, so that the efficiency of cooling the heat resistant insert is further increased, and the life of the electrode is extended. In order to attain this objective, a technique is per se known for determining the relative position between the bottom surface of the water passage internal to the electrode and the tip end surface of the pipe with good accuracy (refer to Patent Document #2).

With regard to the nozzle as well, it is considered that the durability of the nozzle is also enhanced by this improvement of the cooling efficiency. In order to attain this objective, a technique is per se known for widening the water cooling area of the nozzle (refer to Patent Document #3).

Patent Document #1: Japanese Patent Publication 2,640,707.

Patent Document #2: U.S. Patent Publication 2005/92,718.

Patent Document #3: Japanese Laid-Open Patent Publication 2005-118816.

SUMMARY

According to the prior art technique, within the torch, a single passage is constituted by a water passage within the electrode and a water passage around the nozzle being perfectly connected together in series. Accordingly, all of the cooling water which has been fed under pressure from the pump to the torch flows into the water passage within the electrode, and after that flows into the water passage around the nozzle. As proposed in Patent Document #2, in the neighborhood of the bottom of the water passage within the electrode, the cooling water passes through an extremely narrow gap. Due to this, the pressure loss within the electrode is large. On the other hand, the pressure drop in the water passage for nozzle cooling is small as compared to that within the electrode. For example, according to the specification of some commonplace torches, a pressure of around 0.7 MPa is required for supplying water at the rate of 10 liters/minute to the water passage within the electrode; while, by contrast, a pressure of around 0.1 MPa is sufficient for supplying water at the same rate of 10 liters/min to the water passage for nozzle cooling. To put this in another manner, even if cooling water is flowed at the rate of 30 liters/min only to the water passage for cooling the nozzle, the pressure drop in this water passage will not exceed around $0.1\times3\times3=0.9$ MPa, while by contrast, if the water flow within the electrode is made to be 30 liters/min, then the pressure drop within the electrode will become the extremely large value of 6.3 MPa, which is not desirable.

In order to feed cooling water under pressure to a torch having a specification like that described above, normally a pump is used whose maximum discharge pressure is around 1 MPa (i.e. around 10 kg/cm$^2$). In this case, as described above, when water is supplied at a flow rate of around 10 liters/min, the pressure drop within the torch is around $0.7+0.1=0.8$ MPa, and this is close to the maximum discharge pressure of the pump. Accordingly, the upper limit of the flow rate which the pump can supply to the electrode and to the nozzle is around 10 liters/min. The flow rate of the cooling water which is supplied to the electrode and to the nozzle is thus principally prescribed in this manner by the pressure drop within the electrode, since this is approximately equal to the total pressure drop. However, since the influence of attrition of the nozzle due to heat is directly manifested in deterioration of cutting quality, accordingly, in order to suppress such deterioration, there is a strong demand for increase of the cooling water flow rate supplied to the nozzle.

If the discharge pressure of the pump is increased, then the water flow rate is increased, and the lives of the electrode and of the nozzle are extended. However, when the discharge pressure of the pump is increased by a factor of N, the proportional increase of the water flow rate is not N times, but does not exceed $N^{1/2}$ times. For example, if the maximum discharge pressure of the pump is doubled, the rate of increase of the water flow rate only reaches 1.4 times. On the other hand, since the water pressure applied to the torch is doubled, a requirement arises at least to double the withstand pressures of the water seal members of the electrode and the nozzle, in order to prevent water leakage. When these water seal members are thus reinforced, the new problem arises that removal when exchanging the electrode or the nozzle becomes more difficult.

Furthermore, a voltage is applied between the electrode and the nozzle. Accordingly, an electrical current flows between the water passage internal to the electrode and the water passage around the torch, which are close together within the torch and are mutually connected together. Due to this cause, electrical corrosion of the metallic components interior to the torch takes place, and this limits the life of the torch as a whole.

Accordingly, one object of the present invention is to provide a plasma cutting device, and a cooling method for a plasma torch, in which the flow rate of coolant liquid supplied to the nozzle of the plasma torch is increased.

Another object of the present invention is to provide a plasma cutting device, and a cooling method for a plasma torch, in which the life of the plasma torch is extended.

According to a first aspect of the present invention, there is provided a plasma cutting device comprising a plasma torch having an electrode and a nozzle, and a coolant liquid supply device for supplying coolant liquid to said plasma torch, wherein said plasma torch comprises: an electrode coolant liquid passage which supplies coolant liquid from said coolant liquid supply device to said electrode; and a nozzle coolant liquid passage which supplies coolant liquid from said coolant liquid supply device to said nozzle; and wherein at least a portion of said electrode coolant liquid passage and at least a portion of said nozzle coolant liquid passage extend in parallel, so that at least a part of the flow of coolant liquid from said coolant liquid supply device is divided and flown into said electrode coolant liquid passage and said nozzle coolant liquid passage.

With the plasma cutting device of the present invention, at least a portion of the electrode coolant liquid passage of the plasma torch and at least a portion of its nozzle coolant liquid passage extend in parallel, in other words independently. To put this in another manner, the electrode coolant liquid passage of the plasma torch and its nozzle coolant liquid passage are not connected in series so as perfectly to constitute one single passage. By making these two coolant passages in parallel in this manner, in other words independently, at least a portion of the flow of coolant liquid which is supplied to the electrode and at least a portion of the flow of coolant liquid which is supplied to the nozzle are mutually independent, so that it is possible to supply coolant liquid to the electrode and to the nozzle in individually characteristic flow rates. Due to this, it is possible to increase the flow rate of coolant liquid to the nozzle in a simpler and easier manner than in the prior art.

In one embodiment, the entirety of the electrode coolant liquid passage and the entirety of the nozzle coolant liquid passage extend separately and independently within the plasma torch. In this case, the electrode coolant liquid passage and the nozzle coolant liquid passage may be electrically insulated from one another within the plasma torch. Due to this, the problem of electrical corrosion of the plasma torch is ameliorated.

On the other hand, in another embodiment, a portion of the electrode coolant liquid passage and a portion of the nozzle coolant liquid passage may be connected together. Even in this latter case, since at least a portion of the electrode coolant liquid passage of the plasma torch and at least a portion of its nozzle coolant liquid passage extend in parallel, in other words independently, accordingly it is possible to supply coolant liquid to the electrode and to the nozzle in individually characteristic flow rates.

It would be acceptable for the electrode coolant liquid passage and the nozzle coolant liquid passage to have separate and different inlets; or it would be acceptable for them to have a single common inlet. Furthermore, it would also be acceptable for the electrode coolant liquid passage and the nozzle coolant liquid passage to have separate and different outlets; or it would be acceptable for them to have a single common outlet. If the electrode coolant liquid passage and the nozzle coolant liquid passage have separate and different inlets, then it would also be acceptable for these separate inlets to be connected together exterior to the plasma torch, or alternatively it would also be acceptable for them not to be so connected together. In a similar manner, if the electrode coolant liquid passage and the nozzle coolant liquid passage have separate and different outlets, then it would also be acceptable for these separate outlets to be connected together exterior to the plasma torch, or alternatively it would also be acceptable for them not to be so connected together.

In a preferred embodiment, the electrode coolant liquid passage and the nozzle coolant liquid passage of the plasma torch have separate and different inlets, the coolant liquid supply device includes a first coolant liquid outlet and a second coolant liquid outlet which is separate from the first coolant liquid outlet, and the first coolant liquid outlet and the inlet of the electrode coolant liquid passage are connected together by an electrode coolant liquid supply conduit, while the second coolant liquid outlet and the inlet of the nozzle coolant liquid passage are connected together by a nozzle coolant liquid supply conduit which is separate from the electrode coolant liquid supply conduit. By driving the electrode coolant liquid supply conduit for supplying coolant liquid to the electrode and the nozzle coolant liquid supply conduit for supplying coolant liquid to the nozzle separately in this manner, not only within the plasma torch, but exterior to the plasma torch as well, it is possible to supply coolant liquid to the electrode and to the nozzle, in individual characteristic flow rates adapted to their individual cooling requirements, in a yet simpler and easier manner.

Furthermore, in the embodiment described above, the coolant liquid discharge device discharges a first flow of coolant liquid for cooling the electrode from the first coolant liquid outlet and discharges a second flow of coolant liquid for cooling the nozzle from the second coolant liquid outlet, and sets or controls the flow rate of the first flow of coolant liquid and the flow rate of the second flow of coolant liquid separately. By thus setting or controlling the flow rate of the first flow of coolant liquid which is supplied to the electrode and the flow rate of the second flow of coolant liquid which is supplied to the nozzle separately, it is possible to supply coolant liquid to the electrode and to the nozzle, in individual characteristic flow rates adapted to their individual cooling requirements, in a yet simpler and easier manner.

The flow rate of the second flow of coolant liquid which is supplied to the nozzle may be set or controlled to a larger value than the flow rate of the first flow of coolant liquid which is supplied to the electrode. By doing this, it is possible to enhance the durability of the nozzle, and to alleviate the problem of deterioration of the quality of cutting.

Furthermore, in the embodiment described above, the electrode coolant liquid passage and the nozzle coolant liquid passage of the plasma torch may have separate and different outlets; and the coolant liquid supply device may include a first coolant liquid inlet and a second coolant liquid inlet which is separate from the first coolant liquid outlet; and the first coolant liquid inlet may be connected to the outlet of the electrode coolant liquid passage by an electrode coolant liquid return conduit, while the second coolant liquid inlet may be connected to the outlet of the nozzle coolant liquid passage by a nozzle coolant liquid return conduit which is separate from the electrode coolant liquid return conduit. By, in this manner, exterior to the plasma torch, not only using separate coolant liquid supply conduits for supplying the coolant liquid to the electrode and to the nozzle from the coolant liquid supply device, but also using separate coolant liquid return conduits for returning coolant liquid from the electrode and from the nozzle to the coolant liquid supply device as well, it becomes simple and easy electrically to insulate the electrode coolant liquid passage and the nozzle coolant liquid passage from one another within the plasma torch by yet a further level. By doing this, it is possible effectively to ameliorate the problem of electrical corrosion of the plasma torch.

And, according to another aspect of the present invention, there is provided a plasma torch having the structure described above. Moreover, according to yet another aspect of the present invention, there is provided a coolant liquid supply device having the structure described above.

PREFERRED EMBODIMENTS

A plasma cutting device according to an embodiment of the present invention will now be explained. This plasma cutting device is a device which cuts a workpiece using a plasma torch. This plasma torch comprises a removable electrode and a nozzle; the electrode serves the role of generating a plasma arc, while the nozzle serves the role of squeezing down the plasma arc and directing it towards the workpiece. In the following, explanation of this plasma cutting device according to an embodiment of the present invention will concentrate in particular upon the portions thereof which are related to cooling of the plasma torch, and this explanation will make reference to the drawings.

Figure 1:
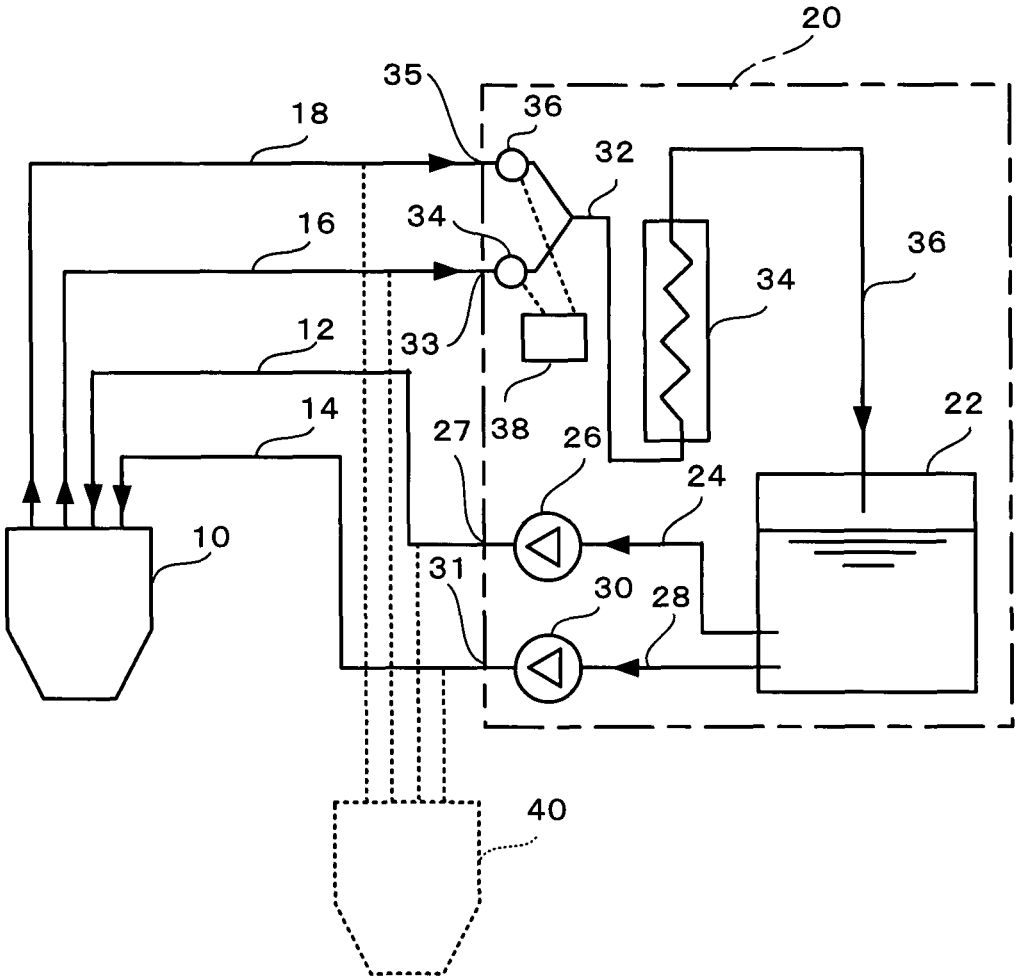
FIG. 1 is a circuit diagram showing the structure of a liquid cooling circuit in an embodiment of the present invention.

FIG. 1 shows a liquid cooling circuit for supplying a coolant liquid—for example, in this embodiment, water (hereinafter termed "cooling water")—to the plasma torch of the plasma cutting device according to this embodiment of the present invention. Here, although the portion of this liquid cooling circuit within the torch is not shown in FIG. 1, this will be described subsequently in detail with reference to FIGS. 2 through 4.

This liquid cooling circuit comprises an electrode liquid cooling circuit through which cooling water circulates in order to cool the electrode within the plasma torch 10, and a nozzle liquid cooling circuit through which cooling water circulates in order to cool the nozzle within the plasma torch 10. And this electrode liquid cooling circuit and this nozzle liquid cooling circuit are provided in such a manner (for example in parallel) that the flow rate of cooling water in each one of them does not substantially experience any influence from the flow rate in the other one. This will be explained in the following in concrete terms.

As shown in FIG. 1, external to the plasma torch 10, there is installed a cooler unit 20 for accumulating cooling water, supplying this cooling water towards the plasma torch 10, and cooling the cooling water which has returned back from the plasma torch 10 and supplying it to the plasma torch 10 for a second time. This cooler unit 20 is connected to the plasma torch 10 via four coolant liquid transport passages: an electrode coolant liquid supply conduit 12, an electrode coolant liquid return conduit 16, a nozzle coolant liquid supply conduit 14, and a nozzle coolant liquid return conduit 18. The electrode coolant liquid supply conduit 12 is a conduit for supplying to the plasma torch 10 water for cooling the electrode within the plasma torch 10, while the electrode coolant liquid return conduit 16 is a conduit for returning this cooling water which has finished cooling the electrode back to the cooler unit 20. And the nozzle coolant liquid supply conduit 14 is a conduit for supplying to the plasma torch 10 water for cooling the nozzle within the plasma torch 10, while the nozzle coolant liquid return conduit 18 is a conduit for returning this cooling water which has finished cooling the nozzle back to the cooler unit 20. As will be described in detail hereinafter, within the plasma torch 10, an electrode coolant liquid passage which supplies cooling water to the electrode and a nozzle coolant liquid passage which supplies cooling water to the nozzle are not connected in series so as to constitute one perfectly integrated passage as in the prior art (so that the flow rates in both of these passages are inevitably bound to be equal), but rather the entire electrode coolant liquid passage and the entire nozzle coolant liquid passage are provided as completely separate and independent passages. Accordingly, after all of the cooling water which has been supplied from the electrode coolant liquid supply conduit 10 to the plasma torch 10 has flowed only in the electrode coolant liquid passage within the plasma torch, then it is ejected to the electrode coolant liquid return conduit 16. Similarly and conversely, after all of the cooling water which has been supplied from the nozzle coolant liquid supply conduit 14 to the plasma torch 10 has flowed only in the nozzle coolant liquid passage within the plasma torch, then it is ejected to the nozzle coolant liquid return conduit 18. For this reason, it is possible to supply cooling water to the electrode and to the nozzle in specific flow rates which are suitable for their individual cooling requirements.

The cooler unit 20 has two separate coolant liquid outlets 27 and 31 for discharging cooling water which is to be supplied to the plasma torch 10 to the exterior of the cooler unit 20, and moreover has two separate coolant liquid inlets 35 and 33 for receiving cooling water which has been discharged from the plasma torch 10 to within the cooler unit 20. Furthermore, a coolant liquid tank 22 which stores cooling water is provided within the cooler unit 20, and two coolant liquid output conduits 28 and 24 project to the exterior from a portion of the coolant liquid tank 22 below the surface level of the water therein. The outlet of the first coolant liquid output conduit 24 is connected to a coolant liquid inlet of a first pump 26, a coolant liquid outlet of this first pump 26 is connected to the first coolant liquid outlet 27 of the cooler unit 20, and the inlet of the electrode liquid supply conduit 12 is also connected to this first coolant liquid outlet 27. Moreover, the outlet of the second coolant liquid output conduit 28 is connected to a coolant liquid inlet of a second pump 30, a coolant liquid outlet of this second pump 30 is connected to the second coolant liquid outlet 31 of the cooler unit 20, and the inlet of the nozzle liquid supply conduit 14 is also connected to this second coolant liquid outlet 31. Furthermore, the outlet of the electrode coolant liquid return conduit 16 is connected to the first coolant liquid inlet 33 of the cooler unit 20, while the outlet of the nozzle coolant liquid return conduit 18 is connected to the second coolant liquid inlet 35 of the cooler unit 20. The first and second coolant liquid inlets 33 and 35 of the cooler unit 20 are connected, within the cooler unit 20, to the inlet of a single first common coolant liquid return conduit 32, the outlet of this first common coolant liquid return conduit 32 is connected to the inlet of a heat exchanger 34, the outlet of this heat exchanger 34 is connected to the inlet of a second common coolant liquid return conduit 36, and the outlet of this second common coolant liquid return conduit 36 opens to an aperture within the water tank 22 above the level of the surface of the water therein.

An electrode liquid cooling circuit is constituted by the coolant liquid tank 22, the first coolant liquid output conduit 24, the first pump 26, the electrode coolant liquid supply conduit 12, the electrode coolant liquid passage within the interior of the torch 10, the electrode coolant liquid return conduit 16, the first common coolant liquid return conduit 32, the heat exchanger 34, and the second common coolant liquid return conduit 36; and water for cooling the electrode flows and circulates in this sequence through these structural elements. Furthermore, a nozzle liquid cooling circuit is constituted by the coolant liquid tank 22, the second coolant liquid output conduit 28, the second pump 30, the nozzle coolant liquid supply conduit 14, the nozzle coolant liquid passage within the interior of the torch 10, the nozzle coolant liquid return conduit 18, the first common coolant liquid return conduit 32, the heat exchanger 34, and the second common coolant liquid return conduit 36; and water for cooling the nozzle flows and circulates in this sequence through these structural elements.

This electrode liquid cooling circuit operates so that the flow rate of cooling water supplied to the electrode becomes equal to a target flow rate for cooling the electrode which is determined in advance. Similarly, the nozzle liquid cooling circuit operates so that the flow rate of cooling water supplied to the nozzle becomes equal to a target flow rate for cooling the nozzle which is determined in advance. As will be understood from the subsequent explanation, the target flow rate for cooling the nozzle is larger than the target flow rate for cooling the electrode. Furthermore, to the cooler unit 20, there are provided a first flow rate sensor 34 which detects the flow rate of cooling water flowing in the electrode liquid cooling circuit (in other words supplied to the electrode), a second flow rate sensor 36 which detects the flow rate of cooling water flowing in the nozzle liquid cooling circuit (in other words supplied to the nozzle), and a flow rate monitor device 38 which performs predetermined anomaly processing such as emission of an alarm or the like, if the flow rate which is detected by the first flow rate sensor 34 drops below a minimum flow rate for cooling the electrode which is set in advance, or if the flow rate which is detected by the second flow rate sensor 36 drops below a minimum flow rate for cooling the nozzle which is set in advance.

As shown by the dotted lines in FIG. 1, it would also be acceptable to provide two plasma torches 10 and 40, or indeed more. In this case, it would be acceptable to connect both of these two different plasma torches 10 and 40 to the one and the same cooler unit 20, in parallel. This type of single cooler unit 20 could include a single coolant liquid tank in common for both of the two different plasma torches 10 and 40, and a plurality of pumps which are individually allocated to the electrodes and to the nozzles of the two different plasma torches 10 and 40. As another variation, each of the two different plasma torches 10 and 40 could be connected to a separate and different cooler unit 20.

Figure 2:
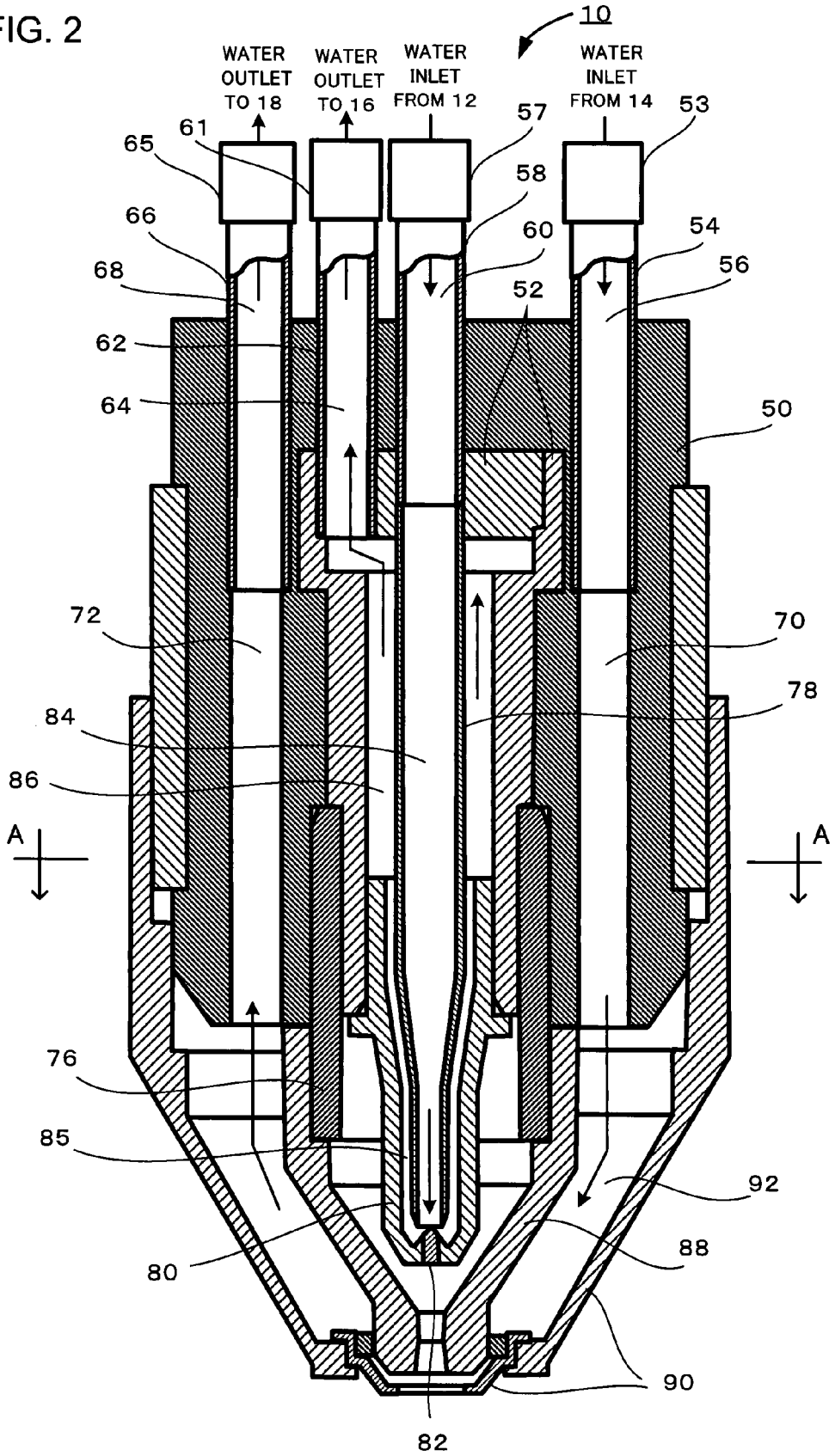
FIG. 2 is a vertical sectional view of a plasma torch which is an embodiment of the present invention, and shows the structure of the cooling liquid passages within this plasma torch.

FIG. 2 shows the structure of the coolant liquid passages within the plasma torch 10, and is a vertical sectional view taken along the central axis of the plasma torch 10.

As shown in FIG. 2, there is provided a cylindrical outer sleeve which is made from an insulating material such as synthetic resin, and an inner sleeve 52 which is made from metal is fitted into the interior of this outer sleeve 50. The outer sleeve 50 may be made from, for example, a thermoplastic epoxy resin or the like, and is formed in a shape so as to surround and enclose the inner sleeve 52 which is made from metal, for example by the use of a resin injection forming die or the like. Four coolant liquid transport passages 54, 58, 62, and 66, which are made from metal, are inserted and fixed Into the base end portions of the outer sleeve 50 and the inner sleeve 52 from their exterior. These coolant liquid transport passages 54, 58, 62, and 66, in concrete terms, are a nozzle cooling water intake conduit 54 for supplying cooling water for cooling the nozzle into the interior of the plasma torch 10, an electrode cooling water intake conduit 58 for supplying cooling water for cooling the electrode into the interior of the plasma torch 10, an electrode cooling liquid exhaust conduit 62 for discharging cooling water which has cooled the electrode to the exterior of the plasma torch 10, and a nozzle cooling liquid exhaust conduit 66 for discharging cooling water which has cooled the nozzle to the exterior of the plasma torch 10. The nozzle coolant liquid intake conduit 54 and the electrode coolant liquid intake conduit 58 have separate inlets. An inlet coupling 53 is provided to the inlet of the nozzle coolant liquid intake conduit 54, and the outlet of the nozzle coolant liquid supply conduit 14 (refer to FIG. 1) which comes from the cooler unit 20 is connected to this inlet coupling 53. Similarly, an inlet coupling 57 is provided to the inlet of the electrode coolant liquid intake conduit 58, and the outlet of the electrode coolant liquid supply conduit 12 (refer to FIG. 1) which comes from the cooler unit 20 is connected to this inlet coupling 57. Moreover, the electrode coolant liquid exhaust conduit 62 and the nozzle coolant liquid exhaust conduit 66 have separate outlets. An outlet coupling 61 is provided to the outlet of the electrode coolant liquid exhaust conduit 62, and the inlet of the electrode coolant liquid return conduit 16 (refer to FIG. 1) which goes to the cooler unit 20 is connected to this outlet coupling 61. Similarly, an outlet coupling 65 is provided to the outlet of the nozzle coolant liquid exhaust conduit 66, and the inlet of the nozzle coolant liquid return conduit 18 (refer to FIG. 1) which goes to the cooler unit 20 is connected to this outlet coupling 65.

Figure 3:
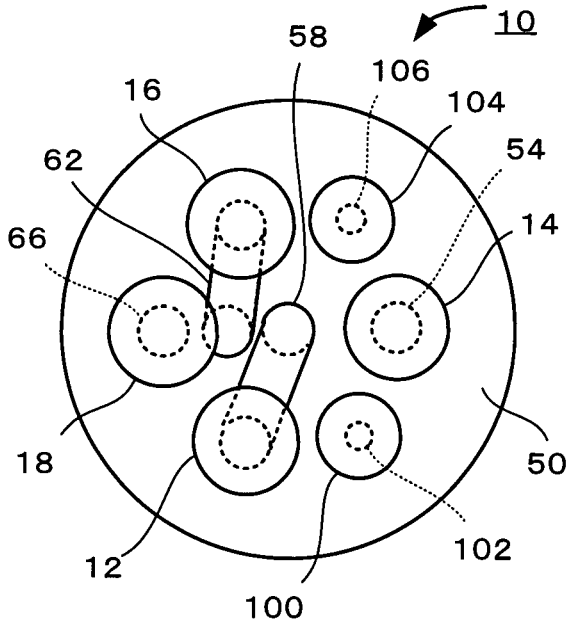
FIG. 3 is a figure showing the arrangement of a plurality of coolant liquid transport passages of the plasma torch of FIG. 2, as seen from its base end.

FIG. 3 shows the arrangement of the various cooling water conduits described above, when the plasma torch 10 is viewed from its base end. As shown in FIG. 3, the nozzle coolant liquid supply conduit 14, the electrode coolant liquid supply conduit 12, the electrode coolant liquid return conduit 16, and the nozzle coolant liquid return conduit 18 which come from the exterior of the plasma torch 10, along with a plasma gas supply conduit 100 and an assist gas supply conduit 104 which also come from the exterior of the torch, are arranged almost around a circle centered upon the central axis of the plasma torch 10. By contrast, the portions of the nozzle coolant liquid intake conduit 54, of the electrode coolant liquid intake conduit 58, of the electrode coolant liquid exhaust conduit 62, and of the nozzle coolant liquid exhaust conduit 66 which are coupled to the base end portion of the inner sleeve 52 are arranged almost along a diametrical line which passes through the central axis of the plasma torch 10.

Accordingly, portions of these conduits, for example of the electrode coolant liquid intake conduit 58 and of the electrode coolant liquid exhaust conduit 62, are each curved into portions separated from the inner sleeve 52, and are connected to the electrode coolant liquid supply conduit 12 and to the electrode coolant liquid return conduit 16 respectively (however, the curved shapes of these conduits are not shown in FIG. 2). It should be understood that the plasma gas supply conduit 100 and the assist gas supply conduit 104 are respectively connected to a plasma gas intake conduit 102 and to an assist gas intake conduit 106 (however, this is not shown in FIG. 2).

Referring to FIG. 2 for a second time, two coolant liquid passages 70 and 72 are pierced through the wall of the outer sleeve 50, from its base end surface towards its tip end surface. The inlet of one coolant liquid passage 70 (hereinafter termed "the nozzle proximal coolant liquid intake passage") is connected to the outlet of a coolant liquid passage 56 (hereinafter termed "the nozzle distal coolant liquid intake passage") which is defined within the nozzle coolant liquid intake conduit 54, while the outlet of the other coolant liquid passage 72 (hereinafter termed "the nozzle proximal coolant liquid exhaust passage") is connected to the inlet of a coolant liquid passage 68 (hereinafter termed "the nozzle distal coolant liquid exhaust passage") which is defined within the nozzle coolant liquid exhaust conduit 66.

A nozzle 88 which is made from metal is removably fitted upon an inner portion of the tip end surface of the outer sleeve 50. And a shield cap 90 is fitted over the tip end portion of the outer sleeve 50 and is removably fixed thereon. This shield cap 90 almost entirely surrounds the nozzle 88 from its outside. A space defined between the outer surface of the nozzle 88 and the inner surface of the shield cap 90 constitutes a nozzle coolant liquid jacket passage 92, which directs coolant liquid flowing thereinto against the outer surface of the nozzle 88. The inlet of this nozzle coolant liquid jacket passage 92 is connected to the outlet of the nozzle proximal coolant liquid intake passage 70, while the outlet of this nozzle coolant liquid jacket passage 92 is connected to the inlet of the nozzle proximal coolant liquid exhaust passage 72.

Figure 4:
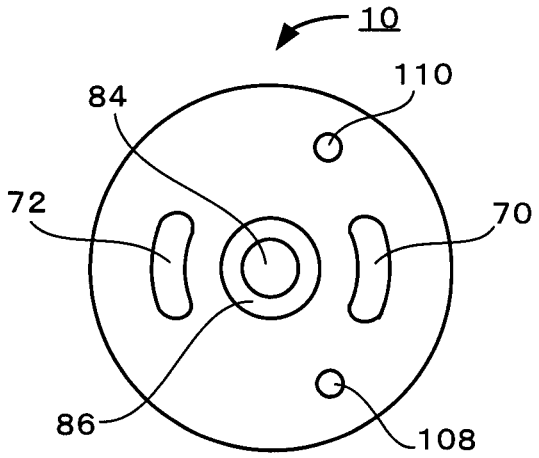
FIG. 4 is a cross section taken in a plane shown by the arrows A-A in FIG. 2, and shows, in a simplified manner, the cross sectional shapes of a nozzle coolant liquid intake passage and a nozzle coolant liquid exhaust passage.

FIG. 4 is a cross section taken in a plane shown by the arrows A-A in FIG. 2, and is a figure showing the cross sectional shapes of the nozzle proximal coolant liquid intake passage 70 and of the nozzle proximal coolant liquid exhaust passage 72 in a simple manner. As shown in FIG. 4, the cross sectional shapes of the nozzle proximal coolant liquid intake passage 70 and of the nozzle proximal coolant liquid exhaust passage 72 are bent elliptical shapes which extend around a circle centered upon the central axis of the plasma torch 10, and thereby it is possible to make the cross sectional areas of these coolant liquid passages 70 and 72 as large as possible, while only increasing the external diameter of the plasma torch 10 as little as possible. It should be understood that the reference symbols 108 and 110 in FIG. 4 respectively denote a plasma gas passage and an assist gas passage.

Referring to FIG. 2 yet again, an electrode 80 which is made from metal is removably fitted to the tip end portion of the inner sleeve 52. A heat resistant insulation barrel 76 such as one made from ceramic and fitted from outside into the tip end portion of the inner sleeve 52 ensures reliable insulation between the electrode 80 and the nozzle 88. The interior of the electrode 80 is a cavity, and this cavity opens at the base end portion of the electrode 80 and communicates with the inner space within the inner sleeve 52. The electrode coolant liquid introduction conduit 78 is disposed within the internal space of the inner sleeve 52, coaxially with the inner sleeve 52. The inlet of the electrode coolant liquid introduction conduit 78 is fixed to the base end portion of the inner sleeve 52, and accordingly is connected to the outlet of the electrode coolant liquid intake conduit 58. The front portion of the electrode coolant liquid introduction conduit 78 is inserted deeply into the cavity within the electrode 80, and the outlet of this electrode coolant liquid introduction conduit 78 opens at a position which is immediately behind a heat resistant insert 82 provided at the tip end portion of the electrode 80. The inner space within the electrode coolant liquid introduction conduit 78 constitutes a passage 84 (hereinafter termed "the electrode proximal coolant liquid intake passage") for conducting cooling water to the vicinity of the tip end portion of the electrode 80. The inlet of this electrode proximal coolant liquid intake passage 84 is connected to the outlet of a coolant liquid passage 60 within the electrode coolant liquid intake conduit 58 (hereinafter termed "the electrode distal coolant liquid intake passage").

The space between the outer surface of the electrode coolant liquid introduction conduit 78 and the inner surface of the electrode 80 constitutes an electrode coolant liquid core passage 85 which directs the cooling water which flows therethrough to the inner surface of the electrode 80. And the space between the outer surface of the electrode coolant liquid introduction conduit 78 and the inner surface of the inner sleeve 52 constitutes a passage 86 (hereinafter termed "the electrode proximal coolant liquid exhaust passage") for discharging coolant liquid from this electrode coolant liquid core passage 85. The inlet of the electrode coolant liquid core passage 85 is connected to the outlet of the electrode proximal coolant liquid intake passage 84 at a position which is immediately behind the heat resistant insert 82, and the outlet of the electrode coolant liquid core passage 85 is connected to the inlet of the electrode coolant liquid exhaust passage 86 at a position at the base end portion of the electrode 80. Moreover, at a position at the base end portion of the inner sleeve 52, the outlet of the electrode coolant liquid exhaust passage 86 is connected to the inlet of a coolant liquid passage 64 (hereinafter termed "the electrode distal coolant liquid exhaust passage") within the electrode coolant liquid exhaust conduit 62.

With the plasma torch 10 having the construction described above, the electrode coolant liquid passage for cooling the electrode consists of the electrode distal coolant liquid intake passage 60, the electrode proximal coolant liquid intake passage 84, the electrode coolant liquid core passage 85, the electrode proximal coolant liquid exhaust passage 86, and the electrode distal coolant liquid exhaust passage 64, and cooling water flows through these passages in this sequence. On the other hand, the nozzle coolant liquid passage for cooling the nozzle consists of the nozzle distal coolant liquid intake passage 56, the nozzle proximal coolant liquid intake passage 70, the nozzle coolant liquid jacket passage 92, the nozzle proximal coolant liquid exhaust passage 72, and the nozzle distal coolant liquid exhaust passage 68, and cooling water flows through these passages in this sequence. Within this plasma torch 10, the above described electrode coolant liquid passage and the above described nozzle cooling water passage are not mutually connected together at all, but are separated as completely independent and different fluid flow passages, and are also mutually electrically insulated from one another. Accordingly, the flow rate of the cooling water for cooling the electrode and the flow rate of the cooling water for cooling the nozzle are determined completely mutually independently based upon the pressure losses in each of these cooling water passages and upon the water pressures from each of the pumps 26 and 30 (refer to FIG. 1), and are free to assume their own intrinsic values without influence from one another. Accordingly, the pressure loss in either one of these coolant liquid passages cannot undesirably limit the flow rate in the other one of these liquid passages, as was the case in the prior art. And, above all, although the pressure loss in the electrode coolant liquid passage is large as compared with the pressure loss in the nozzle coolant liquid passage, since the flow rate in the nozzle coolant liquid passage does not experience any influence of pressure loss from the electrode coolant liquid passage, accordingly it is possible to flow the cooling water for the nozzle in a greater volume than was possible with the prior art.

For example, as has been already explained in connection with the prior art, in the case of a prior art plasma torch of a typical commonplace specification, if the discharge pressure of the pump is 0.8 MPa, then about 10 liters/minute is the upper limit for the cooling water flow rate both for the electrode and for the nozzle, and, when the flow of cooling water is at this upper limit flow rate, the pressure loss in the electrode coolant liquid passage is about 0.7 MPa, while the pressure loss in the nozzle coolant liquid passage is about 0.1 MPa. On the other hand, by contrast, with a plasma torch according to this embodiment in which the resistances in the respective coolant liquid passages are approximately equal to the resistances in the case of the prior art example described above, if the discharge pressures of both of the pumps 26 and 30 are the same as in the example described above, i.e. 0.8 MPa, then it is possible to flow cooling water to the electrode at a rate of 10.6 liters/minute, which is about $(8/7)^{1/2}$ times the flow rate in the prior art, and it is possible to flow cooling water to the nozzle at a rate of 28 liters/minute, which is about $8^{1/2}$ times the flow rate in the prior art. As will be understood from this example, since in particular the flow rate of cooling water which is flowed to the nozzle is clearly increased, accordingly the durability of the nozzle will be clearly enhanced. Generally, with an electrode and a nozzle, the way in which the influence of attrition due to heat appears upon them is different. That is, with the electrode, although a process takes place in which the amount of attrition steadily increases along with progressive increase of the number of times the torch is used, still it is possible to continue use of the torch in the usual manner without any special problem appearing, irrespective of the degree of attrition, until the torch finally arrives at a state in which ignition becomes impossible so that electrode changeover is necessary. By contrast, with the nozzle, provided that there is always some attrition, in the process in which the amount of attrition steadily increases along with progressive increase of the number of times the torch is used, deterioration of the quality of cutting occurs to an extent corresponding to the degree of this attrition. Since the timing for exchanging the nozzle is determined by what degree of deterioration of cutting quality the user can accept, therefore it is necessary to change the nozzle frequently if an extremely high cutting quality is required. Since the durability of the nozzle is clearly enhanced over the prior art by supplying the cooling water in higher volume than in the prior art, accordingly it is possible effectively to suppress deterioration of the cutting quality, and to ameliorate the problem described above.

Moreover, although this matter has also already been explained with reference to the prior art, since, in the interior of the plasma torch, a voltage is applied between the electrode and the nozzle, accordingly an electrical current flows between the electrode coolant liquid passage and the nozzle coolant liquid passage which are mutually connected together in the interior of the plasma torch, and this causes electrical corrosion of the internal components of the torch. By contrast since, with the embodiment of the present invention described above, the electrode coolant liquid passage and the nozzle coolant liquid passage are not mutually connected together in the interior of the plasma torch 10, accordingly there is no such problem of electrical corrosion since these passages are electrically insulated from one another, so that the overall durability of the plasma torch 10 is also enhanced. It should be understood that, as shown in FIG. 1, the electrode liquid cooling circuit and the nozzle liquid cooling circuit are mutually connected together in the interior of the cooler unit 20. However, the distance between the plasma torch 10 and the cooler unit 20 is an order of magnitude longer, as compared to the length of the coolant liquid passages in the interior of the plasma torch 10. Due to this, such mutual connection of the coolant liquid passages in the interior of the cooler unit does not substantially constitute a cause of electrical corrosion within the plasma torch 10.

Although one embodiment of the present invention has been described above, the present invention is not to be considered as only being limited to the above described embodiment; it can also be implemented in various other manners, with various additions and variations. In the following, several variant embodiments of the present invention will be explained.

Figure 5:
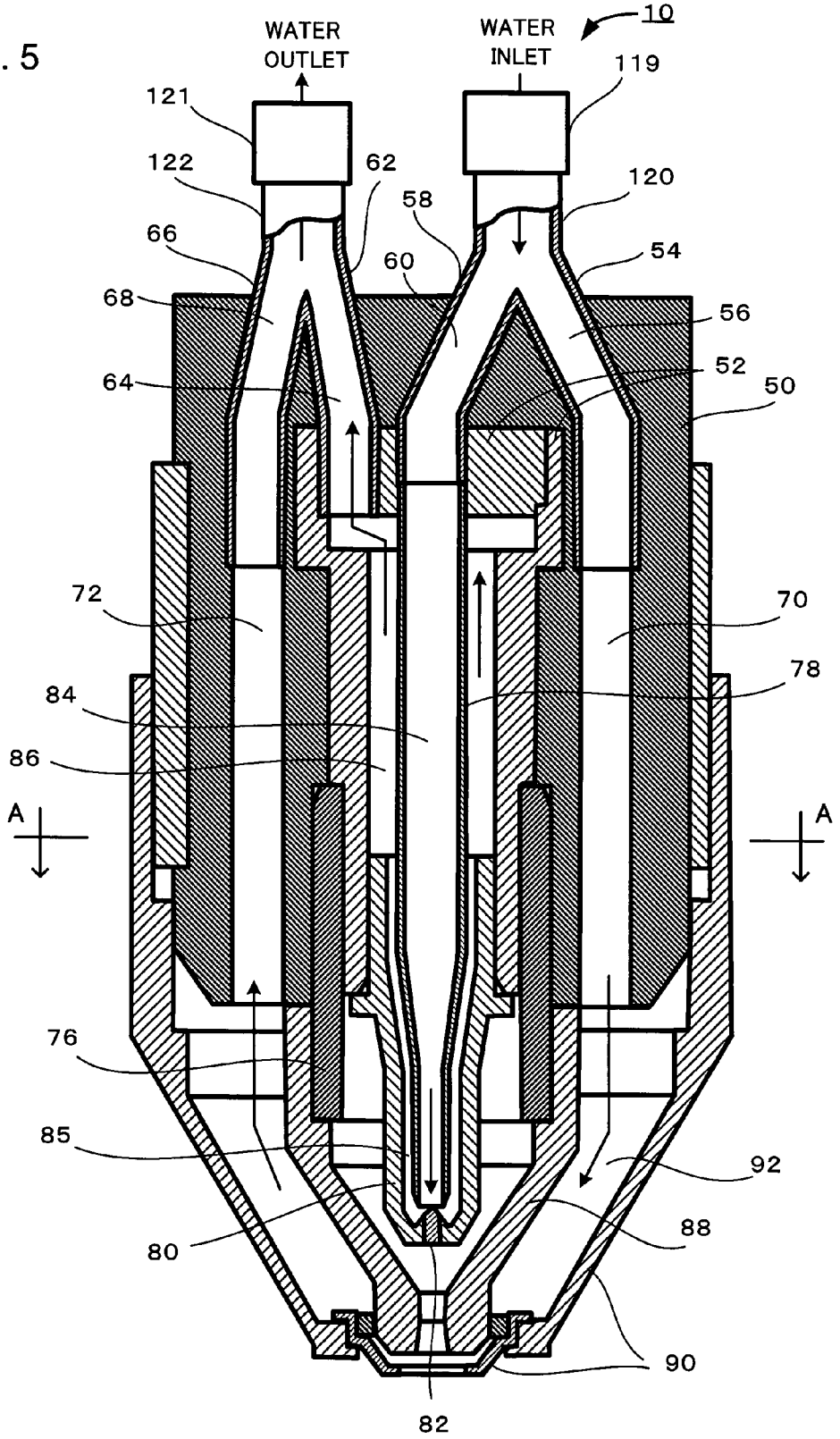
FIG. 5 is a vertical sectional view of a plasma torch according to a variant embodiment of the present invention, showing the structure of its coolant liquid passages.

As shown in FIG. 5, in this plasma torch 10, it would also be acceptable to arrange to provide a single common inlet (for example an inlet coupling 119) for both the nozzle coolant liquid intake conduit 54 and the electrode coolant liquid intake conduit 58. For example, a structure might be adopted in which the nozzle coolant liquid intake conduit 54 and the electrode coolant liquid intake conduit 58 are integrated together in the vicinity of their inlets to constitute a single command coolant liquid intake conduit 120, and the inlet coupling 119 might be provided to the inlet of this common coolant liquid intake conduit 120. A common coolant liquid supply conduit (not shown in the figure) would then come from the cooler unit 20 to the plasma torch 10, and this common coolant liquid supply conduit would be connected to the inlet coupling 119. Furthermore, it would also be acceptable to arrange to provide a single common outlet (for example an outlet coupling 121) for both the nozzle coolant liquid intake conduit 54 and the electrode coolant liquid intake conduit 58. For example, a structure might be adopted in which the electrode coolant liquid exhaust conduit 62 and the nozzle coolant liquid exhaust conduit 66 are integrated together in the vicinity of their outlets to constitute a single command coolant liquid exhaust conduit 122, and the outlet coupling 121 might be provided to the outlet of this common coolant liquid exhaust conduit 122. A common coolant liquid return conduit (not shown in the figure) would then come from the cooler unit 20 to the plasma torch 10, and this common coolant liquid return conduit would be connected to the outlet coupling 121.

Figure 6:
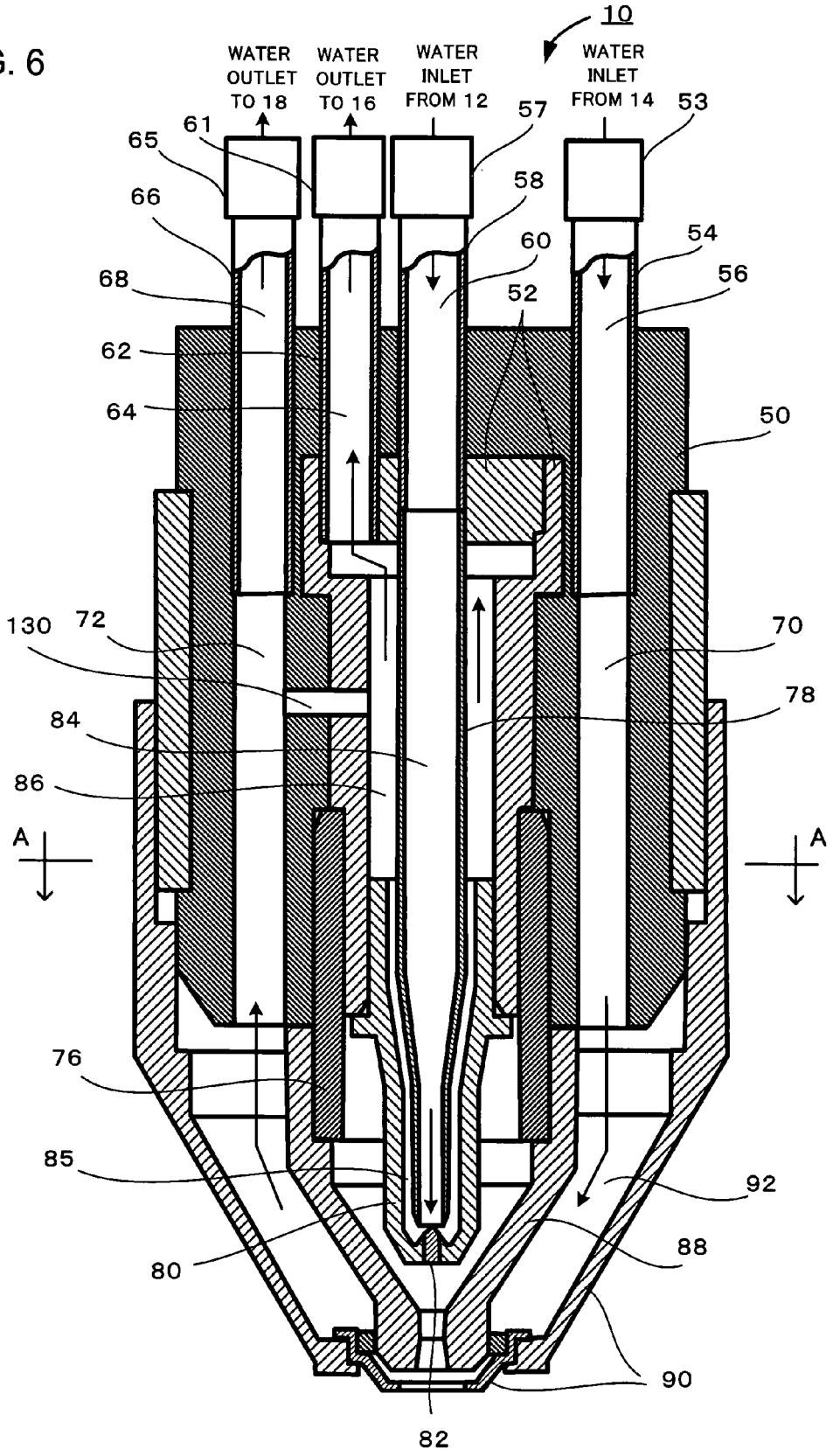
FIG. 6 is a vertical sectional view of a plasma torch according to another variant embodiment of the present invention, showing the structure of its coolant liquid passages.

Furthermore, as shown in FIG. 6, it would also be acceptable for a portion of the electrode coolant liquid passage and a portion of the nozzle coolant liquid passage to be mutually connected together within the plasma torch 10 by a connection conduit 130. It would also be acceptable to combine the variation shown in FIG. 6 with the variation shown in FIG. 5. Moreover, as shown in FIG. 7, in the plasma torch 10, it would also be acceptable on the one hand to arrange for the nozzle coolant liquid intake conduit 54 and the electrode coolant liquid intake conduit 58 to have separate inlets (for example inlet couplings 53 and 67), while on the other hand it is arranged for the electrode coolant liquid exhaust conduit 62 and the nozzle coolant liquid exhaust conduit 66 to have a single common outlet (for example the outlet coupling 121).

Figure 7:
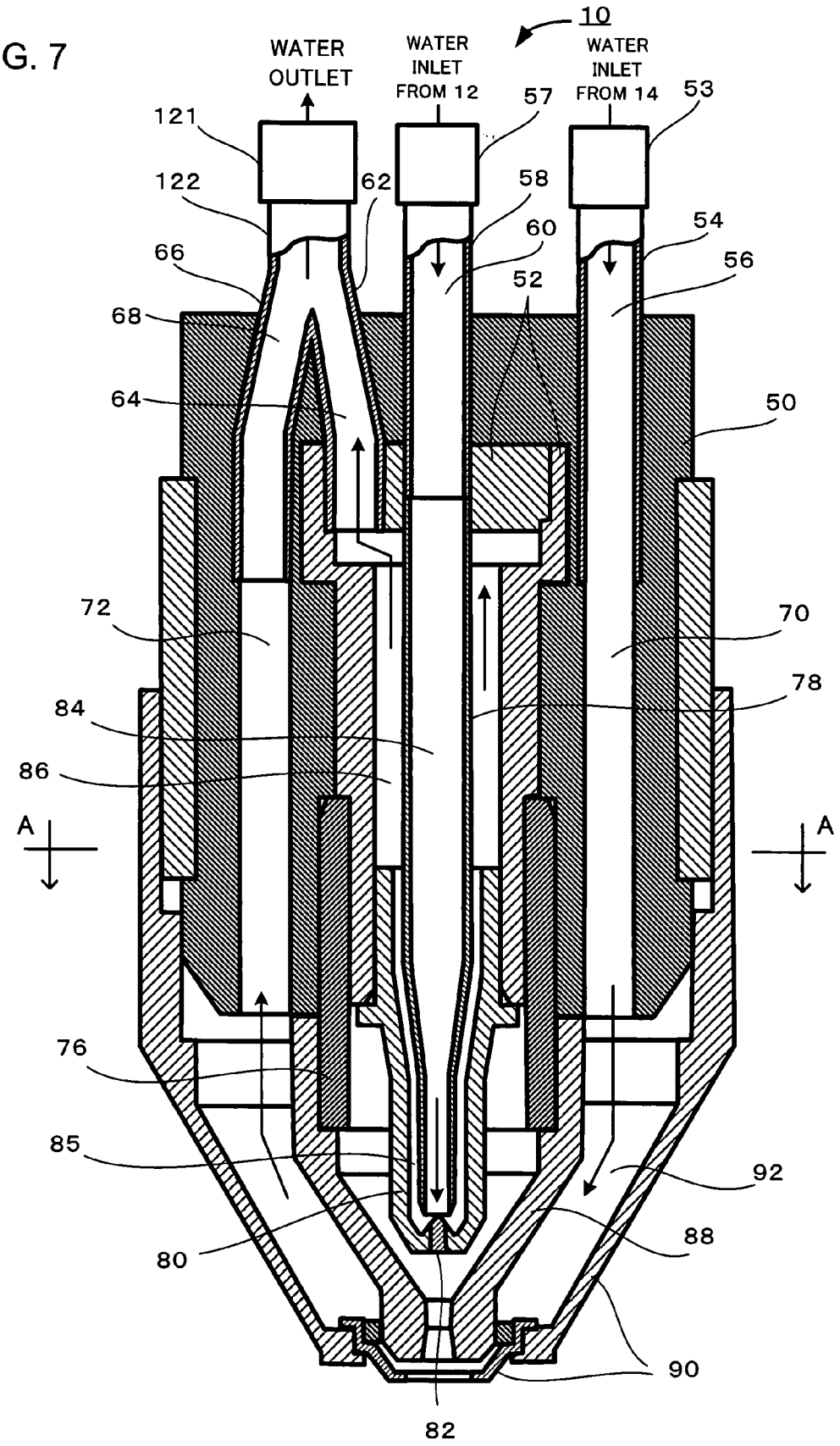
FIG. 7 is a vertical sectional view of a plasma torch according to yet another variant embodiment of the present invention, showing the structure of its coolant liquid passages.

Although, in any of the variant embodiments shown in FIGS. 5, 6, and 7, the electrode coolant liquid passage and the nozzle coolant liquid passage are mutually connected together in the plasma torch 10, this by no means constitutes a structure in which these entire coolant liquid passages are connected together perfectly in series into a single coolant liquid passage, as was the case in the prior art; at least portions of these two coolant liquid passages extend in parallel, in other words independently. Due to this, pressure loss in one of these coolant liquid passages does not exert any substantial influence upon the flow rate in the other one thereof; in other words, it is possible to set or to control the flow rate in each of the cooling passages to a respective intrinsic value. Accordingly, it is possible to increase the flow rate of the cooling water for the nozzle to a higher value than in the prior art. However, from the point of view of preventing electrical corrosion, a structure as shown in FIG. 2, in which the two coolant liquid passages are perfectly separate in the interior of the plasma torch 10 and are mutually insulated from one another, is preferred over the structures shown in FIG. 5 or in FIG. 6.

Moreover although, in the example of a coolant flow structure shown in FIG. 1, the electrode liquid cooling circuit and the nozzle liquid cooling circuit have separate individual pumps 26 and 30, and moreover they have a single coolant liquid tank 22 and a single heat exchanger 34 in common, this is not necessarily the case. As a variant embodiment, it would also be acceptable to provide separate heat exchangers for the electrode liquid cooling circuit and for the nozzle liquid cooling circuit. For example, it would be acceptable to perfectly separate the electrode coolant liquid return conduit 16 and the nozzle coolant liquid return conduit 18 shown in FIG. 1 without mutually connecting them together, and to connect their outlets to inlets of separate individual heat exchangers. Conversely, it would also be acceptable to arrange to provide a single common pump to both the electrode liquid cooling circuit and to the nozzle liquid cooling circuit. For example, it would be acceptable to mutually connect together the electrode coolant liquid supply conduit 12 and the nozzle coolant liquid supply conduit 14 shown in FIG. 1, and to connect their single common inlet to an outlet of the common pump (for example the pump 26). With any of these variations, it would still be possible to set or to control the flow rate of cooling water in the electrode liquid cooling circuit and the flow rate of cooling water in the nozzle liquid cooling circuit to individual characteristic values (and typically to values which are mutually different from one another).

Although various embodiments of the present invention have been described above, these are only given for the purposes of explanation of the present invention; provided that the gist of the present invention is not departed from, it would be possible to implement the present invention in various manners other than those shown in the above described embodiment and variant embodiments.

The invention claimed is:

1. A plasma cutting device comprising a plasma torch, a coolant liquid supply device for supplying coolant liquid to said plasma torch, a nozzle coolant liquid supply conduit, an electrode coolant liquid supply conduit, a nozzle coolant liquid return conduit, an electrode coolant liquid return conduit, a plasma gas supply conduit, and an assist gas supply conduit, said plasma torch comprising:

an electrode;

a nozzle;

an electrode coolant liquid passage that cools said electrode with said coolant liquid supplied from said liquid supply device; and a nozzle coolant liquid passage that cools said nozzle with said coolant liquid supplied from said liquid supply device; wherein a part of said electrode coolant liquid passage and a part of said nozzle coolant liquid passage extend separately, independently, and substantially parallel within said plasma torch, said part of said electrode coolant liquid passage being at least between an intake of said electrode coolant liquid passage to said plasma torch and a vicinity of an end portion of said electrode, and said part of said nozzle coolant liquid passage being at least between an intake of said nozzle coolant liquid passage to said plasma torch and an outer surface of said nozzle, said nozzle coolant liquid supply conduit, said electrode coolant liquid supply conduit, said nozzle coolant liquid return conduit, and said electrode coolant liquid return conduit are exterior to both said plasma torch and said coolant liquid supply device, said nozzle coolant liquid supply conduit supplies said coolant liquid from said coolant liquid supply device to said nozzle coolant liquid passage, said electrode coolant liquid supply conduit supplies said coolant liquid from said coolant liquid supply device to said electrode coolant liquid passage, said nozzle coolant liquid return conduit returns said coolant liquid to said coolant liquid supply device from said nozzle coolant liquid passage after said coolant liquid has passed said outer surface of said nozzle, said electrode coolant liquid return conduit returns said coolant liquid to said coolant liquid supply device from said electrode coolant liquid passage after said coolant liquid has passed said end portion of said electrode, and when said plasma torch is viewed from its base end, said nozzle coolant liquid supply conduit, said electrode coolant liquid supply conduit, said electrode coolant liquid return conduit, said nozzle coolant liquid return conduit, said plasma gas supply conduit, and said assist gas supply conduit are arranged substantially in a circle around a central axis of said plasma torch.

2. The plasma cutting device according to claim 1, wherein the entirety of said electrode coolant liquid passage and the entirety of said nozzle coolant liquid passage extend separately and independently within said plasma torch.

3. The plasma cutting device according to claim 1, wherein said electrode coolant liquid passage and said nozzle coolant liquid passage are mutually electrically insulated from one another within said plasma torch.

4. The plasma cutting device according to claim 1, further comprising a coolant liquid passage which connects together a portion of said electrode coolant liquid passage and a portion of said nozzle coolant liquid passage within said plasma torch.

5. The plasma cutting device according to claim 1, wherein said electrode coolant liquid passage and said nozzle coolant liquid passage of said plasma torch have separate and different inlets to said intakes of said electrode coolant liquid passage and said nozzle coolant liquid passages, respectively.

6. The plasma cutting device according to claim 1, wherein said electrode coolant liquid passage and said nozzle coolant liquid passage of said plasma torch have separate and different outlets.

7. The plasma cutting device according to claim 1, wherein said electrode coolant liquid passage and said nozzle coolant liquid passage of said plasma torch have separate and different inlets to said intakes of said electrode coolant liquid passage and said nozzle coolant liquid passages, respectively;

said coolant liquid supply device comprises:

a first coolant liquid outlet; and a second coolant liquid outlet which is separate from said first coolant liquid outlet;

said electrode coolant liquid supply conduit connects said first coolant liquid outlet to the inlet of said intake of said electrode coolant liquid passage; and the nozzle coolant liquid supply conduit, which is separate from said electrode coolant liquid supply conduit, connects said second coolant liquid outlet to the inlet of said intake of said nozzle coolant liquid passage.

8. The plasma cutting device according to claim 7, wherein said coolant liquid supply device comprises a coolant liquid discharge device which discharges a first flow of said coolant liquid for cooling said electrode from said first coolant liquid outlet and discharges a second flow of said coolant liquid for cooling said nozzle from said second coolant liquid outlet, and which sets or controls a flow rate of said first flow of coolant liquid and a flow rate of said second flow of coolant liquid separately.

9. The plasma cutting device according to claim 8, wherein said coolant liquid discharge device sets or controls the flow rate of said second flow of said coolant liquid to a larger value than the flow rate of said first flow of said coolant liquid.

10. The plasma cutting device according to claim 7, wherein:

said electrode coolant liquid passage and said nozzle coolant liquid passage have separate and different outlets; and said coolant liquid supply device further comprises:

a first coolant liquid inlet; and a second coolant liquid inlet which is separate from said first coolant liquid outlet;

said electrode coolant liquid return conduit connects said first coolant liquid inlet to the outlet of said electrode coolant liquid passage; and said nozzle coolant liquid return conduit, which is separate from said electrode coolant liquid return conduit, connects said second coolant liquid inlet to the outlet of said nozzle coolant liquid passage.

11. A plasma torch which is supplied with coolant liquid from a coolant liquid supply device, comprising:

an electrode;

a nozzle;

an electrode coolant liquid passage that cools said electrode with said coolant liquid supplied from said liquid supply device; and a nozzle coolant liquid passage that cools said nozzle with said coolant liquid supplied from said liquid supply device; wherein a part of said electrode coolant liquid passage and a part of said nozzle coolant liquid passage extend separately, independently, and substantially parallel within said plasma torch, said part of said electrode coolant liquid passage being at least between an intake of said electrode coolant liquid passage to said plasma torch and a vicinity of an end, portion of said electrode, and said part of said nozzle coolant liquid passage being at least between an intake of said nozzle coolant liquid passage to said plasma torch and an outer surface of said nozzle, an exterior nozzle coolant liquid supply conduit supplies said coolant liquid from said coolant liquid supply device to said nozzle coolant liquid passage, an exterior electrode coolant liquid supply conduit supplies said coolant liquid from said coolant liquid supply device to said electrode coolant liquid passage, an exterior nozzle coolant liquid return conduit returns said coolant liquid to said coolant liquid supply device from said nozzle coolant liquid passage after said coolant liquid has passed said outer surface of said nozzle, an exterior electrode coolant liquid return conduit returns said coolant liquid to said coolant liquid supply device from said electrode coolant liquid passage after said coolant liquid has passed said end portion of said electrode, a plasma gas supply conduit, an assist gas supply conduit, and when said plasma torch is viewed from its base end, said nozzle coolant liquid supply conduit, said electrode coolant liquid supply conduit, said electrode coolant liquid return conduit, said nozzle coolant liquid return conduit, said plasma gas supply conduit, and said assist gas supply conduit are arranged substantially in a circle around a central axis of said plasma torch.

12. A device for cooling a plasma torch, the plasma torch comprising an electrode, a nozzle, an electrode coolant liquid passage that cools said electrode with coolant liquid, and a nozzle coolant liquid passage that cools said nozzle with coolant liquid, wherein a part of said electrode coolant liquid passage and a part of said nozzle coolant liquid passage extend separately, independently, and substantially parallel within said plasma torch, said part of said electrode coolant liquid passage being at least between an intake of said electrode coolant liquid passage to said plasma torch and a vicinity of an end portion of said electrode, and said part of said nozzle coolant liquid passage being at least between an intake of said nozzle coolant liquid passage to said plasma torch and an outer surface of said nozzle, the device comprising:

a first coolant liquid outlet which is connected to said electrode coolant liquid passage; and a second coolant liquid outlet which is separate from said first coolant liquid outlet, and which is connected to said nozzle coolant liquid passage, wherein an exterior nozzle coolant liquid supply conduit supplies said coolant liquid from said coolant liquid supply device to the nozzle coolant liquid passage, an exterior electrode coolant liquid supply conduit supplies said coolant liquid from said coolant liquid supply device to the electrode coolant liquid passage, an exterior nozzle coolant liquid return conduit returns said coolant liquid to the coolant liquid supply device from the nozzle coolant liquid passage after the coolant liquid has passed the outer surface of said nozzle, an exterior electrode coolant liquid return conduit returns said coolant liquid to the coolant liquid supply device from the electrode coolant liquid passage after the coolant liquid has passed the end portion of the electrode, a plasma gas supply conduit, an assist gas supply conduit, and when the plasma torch is viewed from its base end, the nozzle coolant liquid supply conduit, the electrode coolant liquid supply conduit, the electrode coolant liquid return conduit, the nozzle coolant liquid return conduit, the plasma gas supply conduit, and the assist gas supply conduit are arranged substantially in a circle around a central axis of the plasma torch.

13. The cooling device according to claim 12, further comprising a coolant liquid discharge device which discharges a first flow of coolant liquid for cooling said electrode from said first coolant liquid outlet and discharges a second flow of coolant liquid for cooling said nozzle from said second coolant liquid outlet, and which sets or controls a flow rate of said first flow of coolant liquid and a flow rate of said second flow of coolant liquid separately.

14. The plasma cutting device according to claim 2, wherein said electrode coolant liquid passage and said nozzle coolant liquid passage of said plasma torch have separate and different inlets to said intakes of said electrode coolant liquid passage and said nozzle coolant liquid passages, respectively.

15. The plasma cutting device according to claim 3, wherein said electrode coolant liquid passage and said nozzle coolant liquid passage of said plasma torch have separate and different inlets to said intakes of said electrode coolant liquid passage and said nozzle coolant liquid passages, respectively.

16. The plasma cutting device according to claim 4, wherein said electrode coolant liquid passage and said nozzle coolant liquid passage of said plasma torch have separate and different inlets to said intakes of said electrode coolant liquid passage and said nozzle coolant liquid passages, respectively.

* * * * *